US006082556A

United States Patent [19]

Primiano et al.

[11] Patent Number: 6,082,556

[45] Date of Patent: Jul. 4, 2000

[54] MERCHANDISING DISPLAY TRACK DEVICE HAVING ATTACHED FRONT WALL

[75] Inventors: Bernard Primiano, Smyrna; Dennis E. Parham, Kennesaw, both of Ga.

[73] Assignee: Display Industries LLC, Smyrna, Ga.

[21] Appl. No.: 09/326,983

[22] Filed: Jun. 7, 1999

Related U.S. Application Data

[63] Continuation of application No. 09/074,937, May 7, 1998.

[51] Int. Cl.[7] ..... A47F 7/00

[52] U.S. Cl. ..... 211/59.2; 211/74

[58] Field of Search ..... 211/59.2, 59.3, 211/74

[56] References Cited

U.S. PATENT DOCUMENTS

| | | | |
|---|---|---|---|
| 2,057,946 | 10/1936 | Harris | 248/289 |
| 4,293,062 | 10/1981 | Bustos | 211/59.2 |
| 4,478,337 | 10/1984 | Flum | 211/49 D |
| 4,598,828 | 7/1986 | Young et al. | 211/59.2 |
| 4,630,739 | 12/1986 | Levenberg | 211/59.2 X |
| 4,685,574 | 8/1987 | Young et al. | 211/59.2 |
| 4,724,968 | 2/1988 | Wombacher | 211/59.3 |
| 5,024,336 | 6/1991 | Spamer | 211/59.2 |
| 5,111,942 | 5/1992 | Bernardin | 211/59.3 |
| 5,161,702 | 11/1992 | Skalski | 211/59.3 |
| 5,240,126 | 8/1993 | Foster et al. | 211/59.3 |
| 5,351,838 | 10/1994 | Flum | 211/59.2 |
| 5,413,229 | 5/1995 | Zuberbuhler et al. | 211/59.3 |
| 5,450,968 | 9/1995 | Bustos | 211/59.2 |
| 5,469,976 | 11/1995 | Burchell | 211/59.3 |
| 5,490,600 | 2/1996 | Bustos | 211/59.2 |
| 5,645,176 | 7/1997 | Jay | 211/59.2 |
| 5,665,304 | 9/1997 | Heinen et al. | 211/59.3 |
| 5,718,341 | 2/1998 | Robertson | 211/59.2 |
| 5,788,090 | 8/1998 | Kajiwara | 211/59.2 |
| 5,855,281 | 1/1999 | Rabas | 211/59.3 |

*Primary Examiner*—David M. Purol
*Assistant Examiner*—Jennifer E. Novosad

[57] ABSTRACT

A merchandising track device includes an elongate track base for carrying articles, such as bottles, cans, bricks or the like, for sliding movement along said track base, a pair of opposed side walls upstanding from the track base and extending at least partially along the opposite side edges of the track base, a pair of front stoppers extending respectively from the side walls toward each other to their respective free side edges, and a front wall member attached to and connecting between the spaced front stoppers. The front wall member has a pair of grippers for receiving the free side edges of the front stoppers. Each gripper includes front and rear elements disposed with a gap therebetween to receive in the gap the free side edge of the respective front stopper. The lower end of the rear element of each gripper is disposed above that of the front element of that gripper.

13 Claims, 5 Drawing Sheets

MERCHANDISING DISPLAY TRACK DEVICE HAVING ATTACHED FRONT WALL

This is a continuation of application Ser. No. 09/074,937, filed May 7, 1998, which is hereby incorporated by reference.

BACKGROUND OF THE INVENTION

This invention relates to a display track device for merchandising articles, and more particularly to a channel-shaped track device having an attached front wall member which enables low-cost molding of such devices.

Channel-shaped track devices have been used in the merchandising of a variety of products. Several track devices, typically, are connected together in a side-by-side relationship and supported on a support surface such as a shelf in a tilted condition. Each device receives articles in a row so that the received articles slide or gravity feed one after another to the front of the respective track as the leading articles in the row are dispensed from the track. Among these known track devices, those having attached front walls or the like are disclosed, for example, in U.S. Pat. Nos. 4,724,968 (Wombacher); 5,240,126 (Foster et al); and 5,351,838 (Flum). Wombacher and Foster et al each shows a track device having a separate front stopper wall attached to the track base. Flum's device includes a separate front cross member attached to upstanding front wall portions. These patents require the respective special constructions of the track devices which constructions are particularly designed to retain the separate walls/members on the track devices.

What is needed, therefore, is a track device having a separate front wall which is attached to the track device utilizing existing portions of the track.

SUMMARY OF THE INVENTION

The track device of the invention has an attached front wall that may provide a billboard surface for carrying information such as an advertisement, a trademark, a price, or the like, and/or it may provide an additional front stopper for preventing leading articles from accidentally exiting the front end of the track device.

The present invention provides a merchandising track device comprising an elongate track base for carrying articles for sliding movement therealong, a pair of opposed side walls upstanding from the track base and extending at least partially along the opposite side edges of the track base respectively, a pair of front stoppers extending respectively from the side walls toward each other to their respective free side edges, and a front wall member formed as a discrete structure separate from the other part of the track device and attached to the front stoppers. The free side edges of the front stoppers are spaced laterally of the track base from each other. The front wall member extends between the front stoppers and has at its opposite ends a pair of gripping means for gripping the free side edges of the front stoppers respectively.

This arrangement allows low-cost application of a variety of designs to the front portion of the track device. To make the track device of the invention, two or more expensive molds for different track devices, for example, can be replaced by one mold for a track device and two or more considerably small-sized, much less expensive molds for different front wall members. Using such less expensive molds, the front portion of the track device can be economically customized depending on customers' needs.

In a preferred embodiment, each of the gripping means comprises front and rear elements disposed with a gap therebetween to receive in the gap the free side edge of the respective front stopper. The front element of each gripping means is disposed alongside the front surface of the respective front stopper whereas the rear element of each gripping means is disposed alongside the rear surface of the respective front stopper. The front and rear elements of each gripping means may be opposed to each other across the thickness of the respective front stopper. Alternatively, the front and rear elements of each gripping means may be disposed at the positions vertically offset from each other. The front wall member may comprise a main portion and a pair of opposite end portions. The end portions of the front wall member may carry the gripping means such that the gripping means project away from each other from the respective end portions.

In another preferred embodiment, the lower edge of the front wall member is disposed along the front end of the track base. In this embodiment, the front wall member may have locking means for securing the front wall member to the track base. Such locking means may have at least one hook element extending downwardly therefrom to engage the front end of the track base.

In still another preferred embodiment, the track device further comprises a front cross member spaced above the track base and bridging between the side walls. The front stoppers extend upward from the track base to their respective upper ends that are spaced below the front cross member.

The objects and advantages of the present invention will be apparent from the following description, the accompanying drawings and the appended claims.

DETAILED DESCRIPTION OF THE PREFERRED EMBODIMENTS

Figure 1:
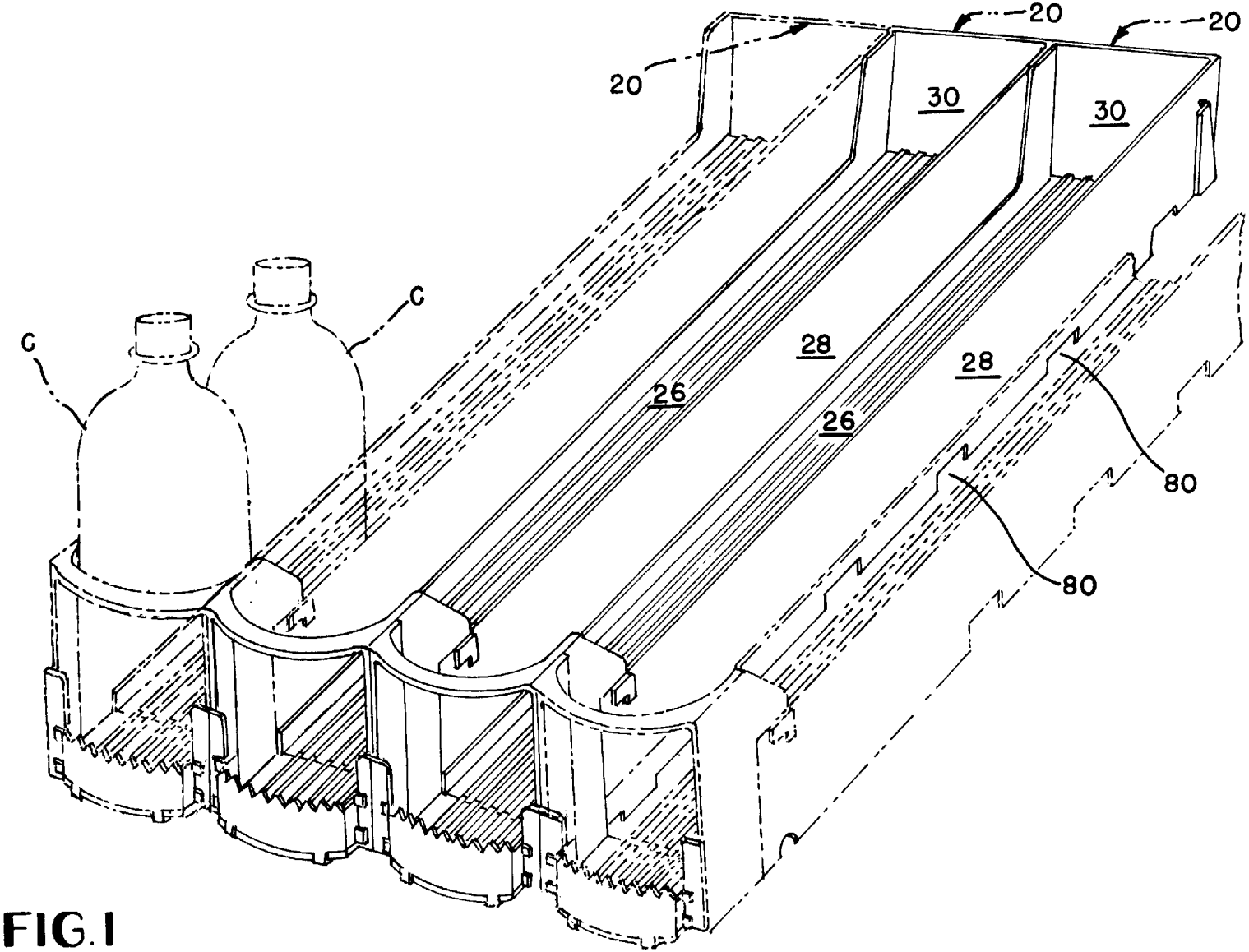
FIG. 1 is a perspective view of a shelf unit assembled from a plurality of track devices according to the present invention.

FIG. 1 illustrates a display shelf unit assembled from multiple track devices according to the present invention. This shelf unit is designed to merchandise articles C such as bottled or canned drink products. The shelf unit includes a plurality of elongate track devices 20 detachably interconnected in a side-by-side, transversely adjacent relationship. The number of the track devices 20 used to assemble the shelf unit is determined such that the size of the shelf unit is suitable for placement on an existing display shelf in a retail store in which the unit is desired to be installed. The interconnection of two adjacent track devices is achieved by connecting means such as connector slots 80 (shown in FIG. 1) cooperating with L-shaped horizontal connector elements 82 (only one shown in FIG. 2). Details of the slots 80 and the elements 82 are described in U.S. Pat. No. 5,634,564 which is hereby incorporated by reference. Additional connecting means are provided at the front portion of each device and will be described later.

The shelf unit may be supported on a horizontal surface and may preferably be incorporated with a spring-loaded pusher for moving the loaded articles forwardly of the unit. An example of conventional pushers is shown in U.S. Pat. No. 5,634,564. Alternatively, the shelf unit may be supported on a forwardly and downwardly tilted surface. In a tilted condition, each track device 20 operates as a so called "gravity feed" dispensing device which does not require any mechanical pushers. On a gravity feed device, the loaded articles have a natural tendency to automatically slide downwardly and forwardly to the front end of the track. The angle of tilt from the horizontal may vary somewhat but such an angle may be about 1 to 20 degrees and preferably about 3.5 to 8 degrees. The angle of tilt in most applications of the invention may be approximately 6 degrees from horizontal.

Figure 2:
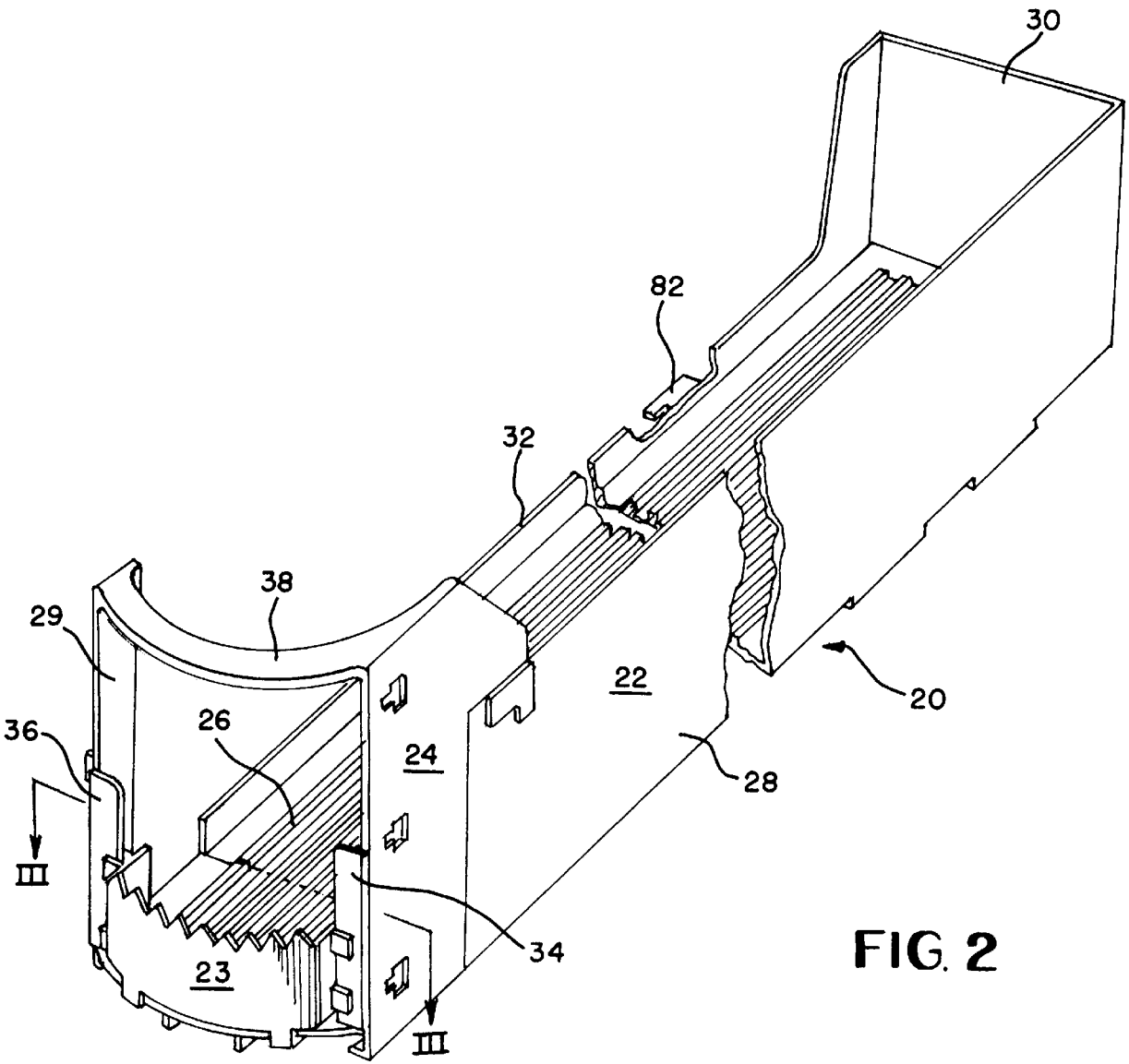
FIG. 2 is a fragmentary perspective view of one of the track devices in FIG. 1.

FIG. 2 illustrates one of the track devices 20 in the form separated from the shelf unit. As all the devices 20 are virtually the same in size and structure, only one device is described hereinafter. The track device 20 has a three-piece construction formed of molded plastic material and includes a track head 24, an elongate track body 22, and a front wall member 23, each formed as a discrete structure separate from the other parts of the track device 20. The track head 24 and the track body 22 are mechanically connected together to form the primary part of the track device 20 wherein the respective floor portions of the track head 24 and the track body 22 provide a continuous track base 26 for slidably supporting articles such as bottles, cans or the like. The mechanism for connecting the head 24 and the body 22 is disclosed in U.S. patent application Ser. No. 08/967,381 filed Nov. 8, 1997, which is owned by the assignee of the present application and which is hereby incorporated by reference.

Beside the track base 26, the primary part includes opposite side walls 28 and 29, a rear wall 30, a side lip 32, a pair of lower front stoppers in the form of upright members 34 and 36, and an upper front stopper in the form of a cross member 38. The side wall 28 is upstanding from and extending entirely along one of the side edges of the track base 26. The rear wall 30 is upstanding from the rear end of the track base 26. The side lip 32 is formed partially along the other side edge of the track base 26. The other side wall 29 is a post-like portion upstanding from the other side edge of the track base 26 adjacent to its front end. The front cross member 38 is spaced above the track base 26 and extends transversely of the device 20 to bridge between the respective upper ends of the side walls 28 and 29. The cross member 38 is the portion against which the leading articles on the respective track device 20 rest when they reach one by one the front end of the device. Details of the cross member are described in U.S. Pat. No. 5,645,176 which is hereby incorporated by reference.

Figure 3:
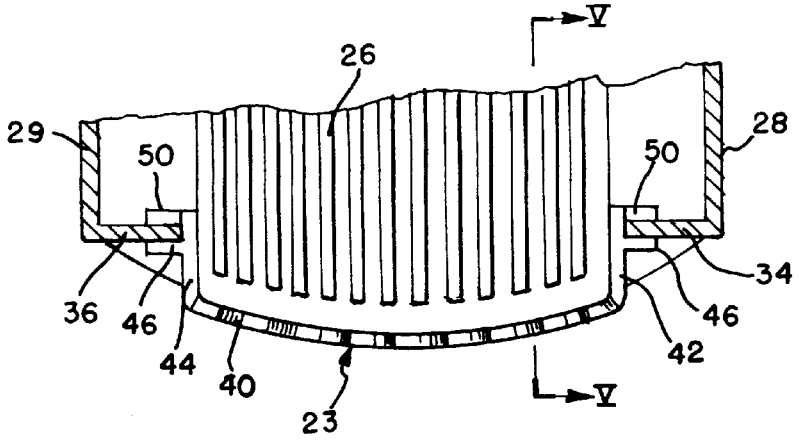
FIG. 3 is a view taken along the line III—III in FIG. 2.
Figure 4:
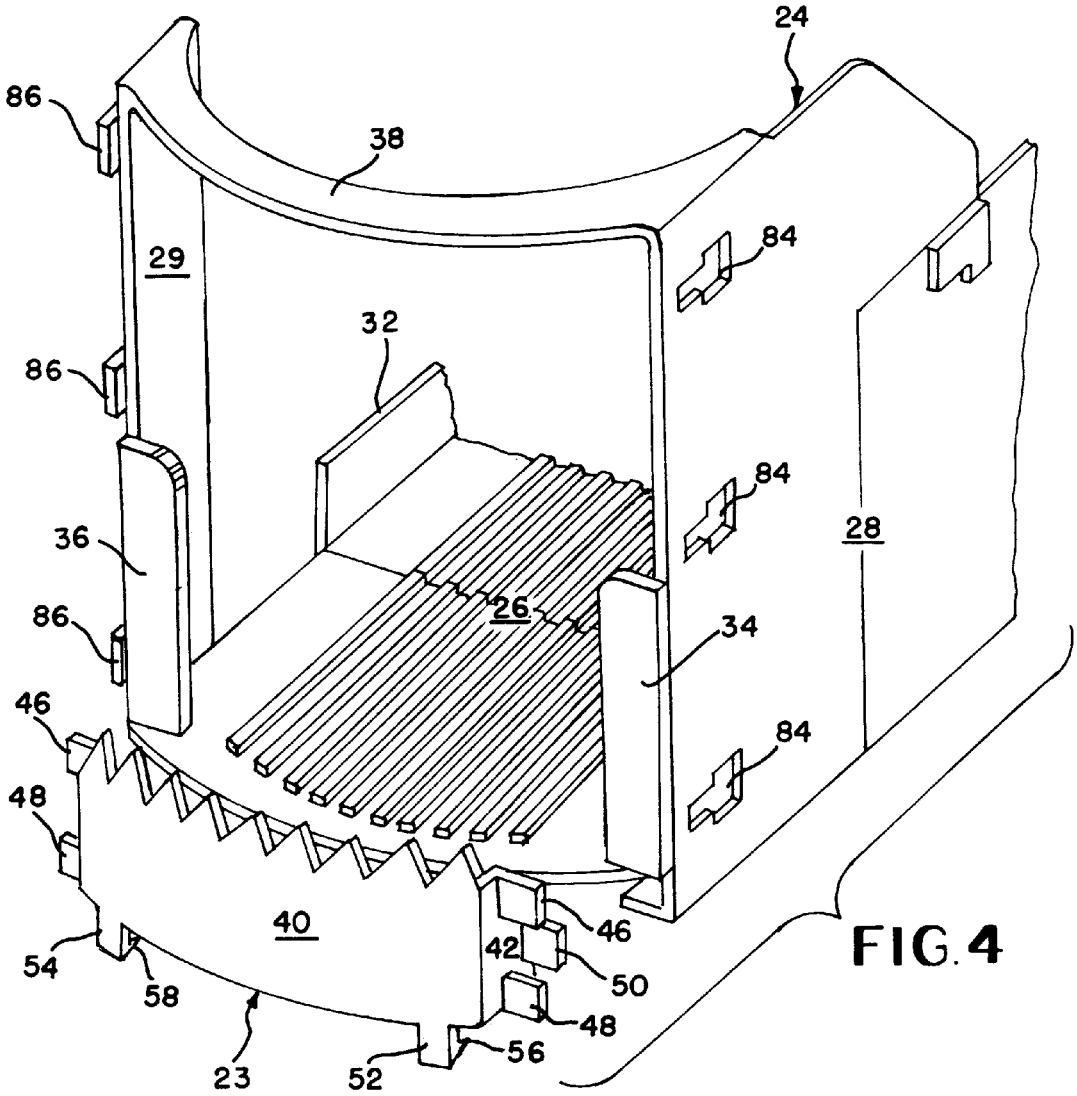
FIG. 4 is an enlarged, exploded perspective view of the track device in FIG. 2.

As best shown in FIG. 4, the lower front stoppers 34 and 36 extend upwardly from the track base 26 along the respective front edges of the side walls 28 and 29. The respective upper ends of the lower front stoppers 34 and 36 are spaced below the cross member 38. As shown in FIG. 3, the outer side edges of the lower stoppers 34 and 36 are joined to the front edges of the side walls 28 and 29 so that the stoppers 34 and 36 project toward each other to their respective inner side edges which are laterally spaced from each other. These lower stoppers 34 and 36 cooperate with the upper stopper 38 to arrest the leading articles. As apparent from FIG. 1, the track base 26, the side wall 28, and the side wall 28 of the adjacent track device 20, in cooperation, define a channel for receiving a row of articles C.

Returning to FIGS. 3 and 4, the front wall member 23 includes a main portion in the form of an arcuate strip 40 and pair of opposite end portions in the form of backwardly projecting tabs 42 and 44. The curvature of the main portion 40 is such that the main portion 40 conforms to the curved or rounded front end of the track base 26, allowing the lower edge of the main portion 40 to be alongside the front end of the track base 26 when the member 23 is attached to the device as shown in FIG. 2. The end portions 42 and 44 carry gripping means for gripping the lower stoppers 34 and 36, respectively. Each gripping means comprises a set of fingers, i.e., a pair of vertically spaced front fingers 46 and 48 and one rear finger 50. The rear finger 50 is disposed at the position vertically offset as well as rearwardly spaced from the front fingers 46 and 48. The respective finger sets of the opposite gripping means project away from each other from the end portions 42 and 44, respectively. A gap "G" (shown in FIG. 5) is defined between the front surface of the rear finger 50 of each gripping means and the rear surfaces of the associated front fingers 46 and 48. The size of the gap "G" is generally equal to or slightly greater than the thickness of each lower stopper. The fingers 46, 48 and 50 thus arranged can grip the free side edge of the respective lower front stopper to secure the front wall member 23 to the primary part of the device. How to attach the member 23 to the primary part will be described later.

Figure 5:
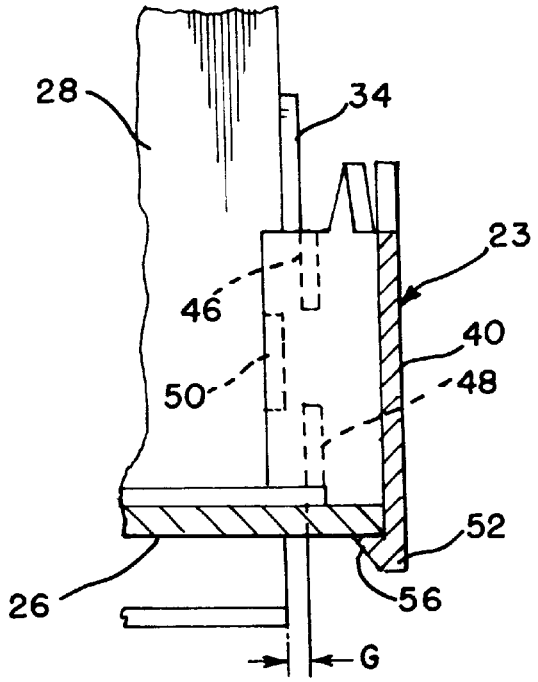
FIG. 5 is a view taken along the line V—V in FIG. 3.

The front wall member 23 also includes locking means for securing the member 23 to the track base 26. Such locking means is shown in FIGS. 4 and 5 as a pair of hook elements 52 and 54 formed on the main portion 40. The hook elements 52 and 54 project downwardly from the lower edge of the main portion 40 and have rearwardly projecting ledges 56 and 58 for engaging the underside of the track base 26. The respective lower faces of the ledges 56 and 58 slope upwardly and rearwardly to facilitate engagement of the elements 52 and 54 with the track base 26.

The vertical size of the front wall member 23 is less than the distance between the front cross member 38 and the track base 26 and is, more preferably, less than the distance between the cross member 38 and the upper ends of the lower stoppers 34 and 36. This arrangement can facilitate attachment of the front wall member 23 to the primary part.

The illustrated main portion 40 has a jagged or serrated upper edge which is formed for the aesthetic purpose only. Not only the upper edge but also the entire main portion 40 may take any configuration as long as it is suitable for providing a billboard surface and/or to serve as a stopper for preventing accidental exiting of the leading articles.

In addition, keyhole apertures 84 (shown in FIG. 4) are formed in the side wall 28 of the device 20 to connect the track head 24 with the adjacent like track head. Mating with the keyhole apertures 84 are headed tabs 86 of a T-shaped vertical cross section projecting sideward from the other side wall 29. These apertures 84 and tabs 86 cooperate with the aforementioned slots and elements 80 and 82 to interconnect the track device 20 with an adjacent like track device. In place of these illustrated connecting means, however, a variety of conventional mechanisms may be used to secure two adjacent track devices 20 in a side-to-side, transversely adjacent relationship.

The front wall member 23 may be attached to the primary part of the track device in the following manner: The front wall member 23 is moved down from the position above the lower front stoppers 34 and 36 such that the lower stoppers 34 and 36 are inserted into the respective gaps "G" of the gripping means. Then, the wall member 23 is slid down along the lower stoppers 34 and 36 until the lower ends of the hook elements 52 and 54 abut the track base 26. The wall member 23 is then forced down so that the sloping lower faces of the hook elements 52 and 54 are pressed on the front end of the track base 26. This causes the hook elements 52 and 54 to flex slightly forward and finally allows the respective ledges 56 and 58 to snap-engage the underside of the track base 26 as shown in FIG. 5. Due to this engagement, the wall member 23 is locked in position and prevented from sliding upward along the lower stoppers 34 and 36 for detachment from the device.

It will be recognized that many variations may be made to the foregoing within the scope of the present invention. For example, the front cross member 38 may be omitted from the track device. In this case, the front fingers 46 and 48 may be outwardly lengthened and provided with hooks for engaging the outer surfaces of the side walls 28 and 29 to structurally compensate for absence of the cross member 38. It should be also recognized that in the structure without the cross member 38, the lower front stoppers 34 and 36 may be fully extended to the upper edges of the side walls 28 and 29.

Figure 7:
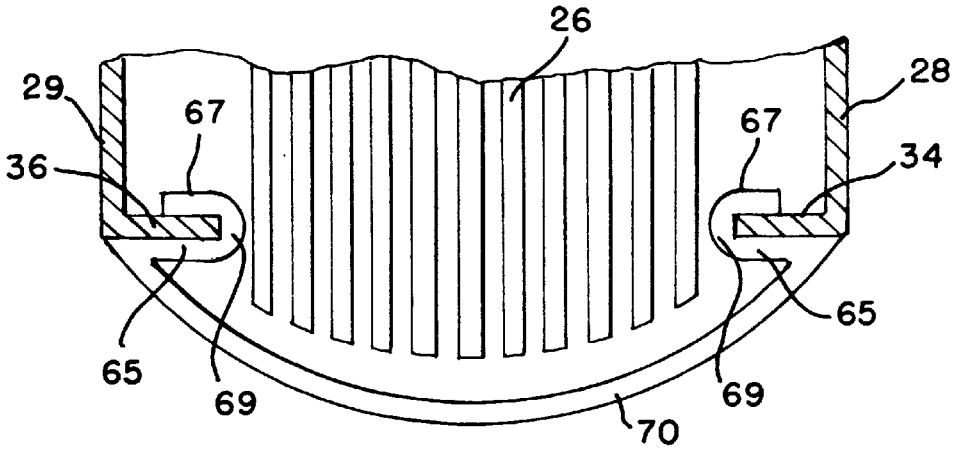
FIG. 7 is a view taken along the line VII—VII in FIG. 6.
Figure 6:
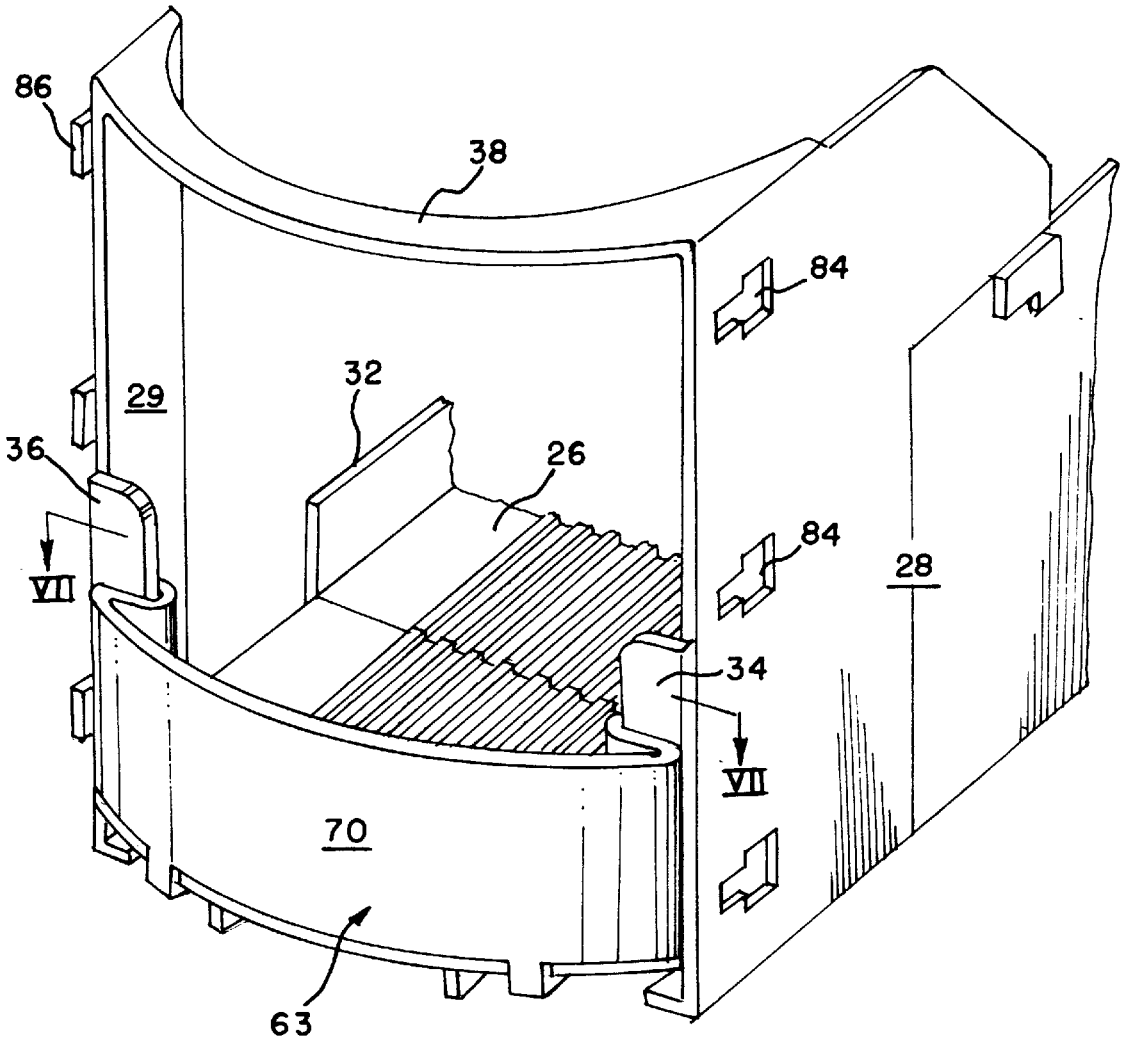
FIG. 6 is an enlarged, fragmentary perspective view of the second embodiment of the present invention.

It should be further recognized that in place of the gripping means in the foregoing arrangement, those of a different arrangement may be employed. An example of such a variation is illustrated in FIGS. 6 and 7 wherein a modified front wall member 63 is attached to the primary part that is virtually identical to that in the foregoing embodiment. The front wall member 63 includes a main portion 70 of a length that allows the portion 70 to fully extend between the side walls 28 and 29, and U-shaped opposite end portions. Each end portion includes a front element 65, a rear element 67 and a curved element 69 interconnecting the front and rear elements 65 and 67. The front elements 65 extend toward each other from the opposite ends of the main portion 70 and are joined to the respective curved elements 69. The elements 69, while curving, extends rearward from the respective front elements 65. The rear elements 67 extend away from each other from the respective curved elements 69. The rear element 67 of each gripping means is disposed at the position directly opposed to and rearwardly spaced from the adjacent front element 65. A gap is defined between the front and rear elements 65 and 67 of each gripping means. The size of such a gap is generally equal to or slightly greater than the thickness of each lower stopper 34 and 36 so that the elements 65 and 67 can grip the free side edge of the respective lower stopper. The way to attach the member 70 to the primary part of the device is virtually identical to that described in the foregoing embodiment.

What is claimed is:

1. A merchandising track device for displaying articles, said track device comprising:

an elongate track base for carrying articles for sliding movement along said track base;

a pair of opposed side walls upstanding from said track base and extending at least partially along opposite side edges of said track base respectively;

a pair of front stoppers extending respectively from said side walls toward each other to respective free side edges thereof, said free side edges of said front stoppers being spaced laterally of said track base from each other;

a front cross member spaced above said track base and bridging between said side walls, said front stoppers extending upward from said track base to respective upper ends thereof disposed at a distance below said front cross member; and a front wall member formed as a discrete structure separate from the other part of said track device and attached to said front stoppers, said front wall member extending between said front stoppers and having a pair of gripping means for receiving said free side edges of said front stoppers respectively for vertical movement of said front wall member along said front stoppers whereby said front wall member is attached to said front stoppers, wherein each of said gripping means comprises front and rear elements disposed with a gap therebetween to receive in said gap said free side edge of a respective one of said front stoppers, said front and rear elements of said each gripping means being arranged vertically along said free side edge of said respective front stopper, said front element of said each gripping means being disposed alongside a front surface of said respective front stopper, said rear element of said each gripping means being disposed alongside a rear surface of said respective front stopper.

2. The track device according to claim 1, wherein said front and rear elements of said each gripping means are opposed to each other across a thickness of said respective front stopper.

3. The track device according to claim 1, wherein said front and rear elements of said each gripping means are disposed at positions vertically offset from each other.

4. The track device according to claim 3, wherein said front wall member comprises a main portion extending transversely of said track base and a pair of opposite end portions extending longitudinally of said track base, said gripping means being joined respectively to said end portions of said front wall member and project away from each other from said end portions.

5. The track device according to claim 1, wherein said front wall member has a lower edge disposed along a front end of said track base.

6. The track device according to claim 5, wherein said front wall member comprises locking means for securing said front wall member to said track base.

7. The track device according to claim 6, wherein said locking means comprises at least one hook element extending downwardly therefrom to engage said front end of said track base.

8. A merchandising track device for displaying articles, said track device comprising:

an elongate track base for carrying articles for sliding movement along said track base;

a pair of opposed side walls upstanding from said track base and extending at least partially along opposite side edges of said track base respectively;

a pair of front stoppers extending respectively from said side walls toward each other to respective free edges thereof, said free side edges of said front stoppers being spaced laterally of said track base from each other; and a front wall member formed as a discrete structure separate from the other part of said track device and attached to said front stoppers, said front wall member extending between said front stoppers and having a pair of gripping means for receiving said free side edges of said front stoppers respectively whereby said front wall member is attached to said front stoppers, wherein each of said gripping means comprises a first front element and a rear element, said front and rear elements of said each gripping means being disposed with a gap therebetween to receive in said gap said free side edge of a respective one of said front stoppers so that said front wall member is vertically slidable along said front stoppers, said rear element of said each gripping means having a lower end disposed above a lower end of said first front element of said each gripping means.

9. The track device according to claim 8, wherein said first front and said rear element of said each gripping means are disposed at positions vertically offset from each other, said rear element of said each gripping means being disposed at a higher elevation than said front element of said each gripping means.

10. The track device according to claim 8, wherein said lower end of said rear element of said each gripping means is disposed above a lower edge of said front wall member.

11. The track device according to claim 8, wherein each of said gripping means further comprises a second front element disposed above said first front element.

12. The track device according to claim 8, wherein said first front element of said each gripping means is disposed alongside a front surface of said respective front stopper, and said rear element of said each gripping means is disposed alongside a rear surface of said respective front stopper.

13. The track device according to claim 8, wherein said front wall member comprises a main portion extending transversely of said track base and a pair of opposite end portions extending longitudinally of said track base, said first front and said rear element of said each gripping means being joined to a respective one of said end portions of said front wall member, said front and rear elements of one of said gripping means projecting away from said front and rear elements of the other gripping means.

* * * * *